US006345720B1

(12) United States Patent
Redden et al.

(10) Patent No.: US 6,345,720 B1
(45) Date of Patent: Feb. 12, 2002

(54) PACKAGING TRAY

(75) Inventors: John D. Redden, Round Rock; Allan M. Fetty; Richard M. Greig, both of Austin, all of TX (US)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 09/734,521

(22) Filed: Dec. 11, 2000

(51) Int. Cl.[7] ..... B65D 85/00
(52) U.S. Cl. ..... 206/725; 206/564; 206/707
(58) Field of Search ..... 206/320, 449, 206/485, 561, 564, 591–594, 587, 722, 723, 725, 521, 707; 229/406

(56) References Cited

U.S. PATENT DOCUMENTS 3,016,177 A * 1/1962 Chaplin ..... 206/521
5,806,683 A * 9/1998 Gale ..... 206/593
5,857,573 A * 1/1999 Pakeriasamy ..... 206/723
6,010,007 A * 1/2000 Moren et al. ..... 206/587
6,145,663 A * 11/2000 Kim et al. ..... 206/593

* cited by examiner

*Primary Examiner*—Luan K. Bui
(74) *Attorney, Agent, or Firm*—Williams, Morgan & Amerson, P.C.

(57) ABSTRACT

A packaging tray includes a base member, first and second side members, and a first top member. The base member has a first plurality of channels defined therein. The first and second side members extend from the base and are rotatable with respect to the base. The first top member extends from one of the first and second side members and is rotatable with respect to the one of the first and second side members. The first top member includes a second plurality of channels defined therein. The first plurality of channels are aligned with the second plurality of channels.

14 Claims, 3 Drawing Sheets

PACKAGING TRAY

BACKGROUND OF THE INVENTION

1. Field of the Invention

This invention relates generally to packaging for shipping products and, more particularly, to a single-piece packaging tray useful for packaging items, such as processor modules, for shipping.

2. Description of the Related Art

Packages used in the shipping of sensitive electronic devices protect the devices from both physical damage resulting from bumping and jostling during transit and electrical damage resulting from static electricity discharge. Many electronic devices sensitive to physical and/or electrical damage, such as processor modules (i.e., including a microprocessor, instruction cache and controller, data cache and controller, bus interface unit, etc.), are extremely costly. A single shipping container may hold as many as fifteen microprocessor modules, each valued at hundreds of dollars. For obvious reasons, it is desirable to reduce the likelihood of damage to the processor modules during shipping.

One exemplary packaging tray for shipping processor modules includes two complimentary trays. The bottom tray includes channels for securing the processor modules. Channels in the top tray cooperate with the channels in the bottom tray to form an enclosure for securing the processor module in place. The processor modules are loaded into the bottom tray, with the bottom tray being previously placed in a shipping box. Subsequently, the top tray is fit over the processor modules and the bottom tray, and the shipping box is closed. A two-piece packaging tray has several disadvantages. First, the top and bottom trays are separate inventory items and must be stored, tracked, and ordered separately. Second, although relatively rare, there have been instances where the processor modules were loaded into the bottom tray and the top tray has not been put in place prior to closure of the shipping box.

The present invention is directed to overcoming, or at least reducing the effects of, one or more of the problems set forth above.

SUMMARY OF THE INVENTION

One aspect of the present invention is seen in a packaging tray including a base member, first and second side members, and a first top member. The base member has a first plurality of channels defined therein. The first and second side members extend from the base and are rotatable with respect to the base. The first top member extends from one of the first and second side members and is rotatable with respect to the one of the first and second side members. The first top member includes a second plurality of channels defined therein. The first plurality of channels are aligned with the second plurality of channels.

BRIEF DESCRIPTION OF THE DRAWINGS

The invention may be understood by reference to the following description taken in conjunction with the accompanying drawings, in which like reference numerals identify like elements, and in which.

Figure 1:
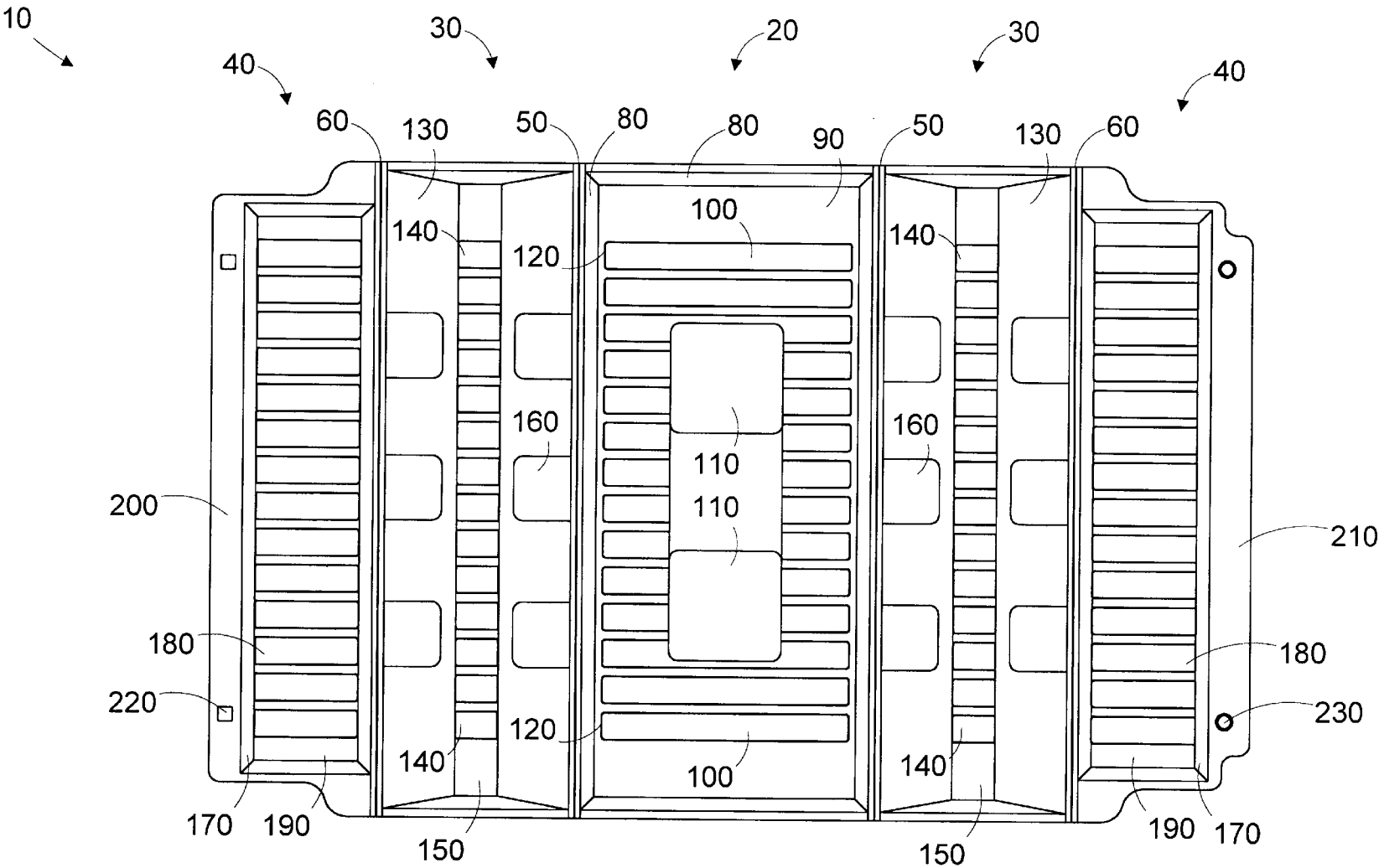
FIG. 1 is a top view of a packaging tray in accordance with one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
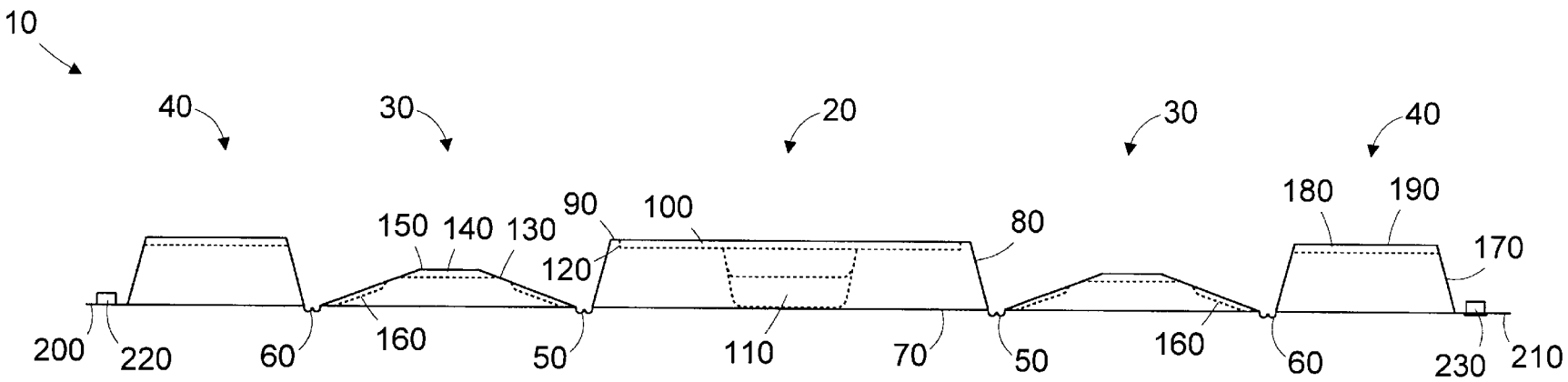
FIG. 2 is an end view of the packaging tray of FIG. 1 in an open position.

Referring now to the Figures, a packaging tray 10 in accordance with one illustrative embodiment of the present invention is illustrated. The packaging tray 10 is described with simultaneous reference to a top view of the packaging tray 10 shown FIG. 1, an end view of the packaging tray 10 in an open position shown in FIG. 2, and an end view of the packaging tray 10 in a closed position shown in FIG. 3. The packaging tray 10 is adapted to secure articles of manufacture, such as processor modules 15 (shown in phantom lines in FIG. 3), during shipping.

The packaging tray 10 includes a base member 20, side members 30, and top members 40. In the illustrated embodiment, the packaging tray 10 is contiguous in that it is formed from a single sheet of source material. The packaging tray 10 is formed from an anti-static material, such as a Polyethylene Terephthalate (PET) or Polyethylene Terephthalate, Glycol Modified (PETG) material using a conventional thermal forming process. Hinges 50 are disposed between the side members 30 and the base member 20, and hinges 60 are disposed between the side members 30 and the top members 40. The hinges 50, 60 allow the side and top members 30, 40 to be folded such that the side members 30 contact sides of the processor module 15, and the top members 40 contact a top of the processor module 15. In the illustrated embodiment, the hinges 50, 60 have a roughly w-shaped cross-section, although other cross-sections, such as c-shaped, may be used.

The base member 20 includes a bottom edge 70, from which sloped sidewalls 80 extend. A top surface 90, raised with respect to the bottom edge 70, is defined between the sidewalls 80. A first plurality of channels 100 are defined in the top surface 90 for engaging with the processor module 15. A plurality of support feet 110 extend downwardly from the top surface 90, roughly in the same plane as the bottom edge 70 for providing structural support for the base member 20 while the processor modules 15 are being loaded into the packaging tray 10. The channels 100 include end walls 120 that prevent transverse movement of the processor modules 15.

Figure 3:
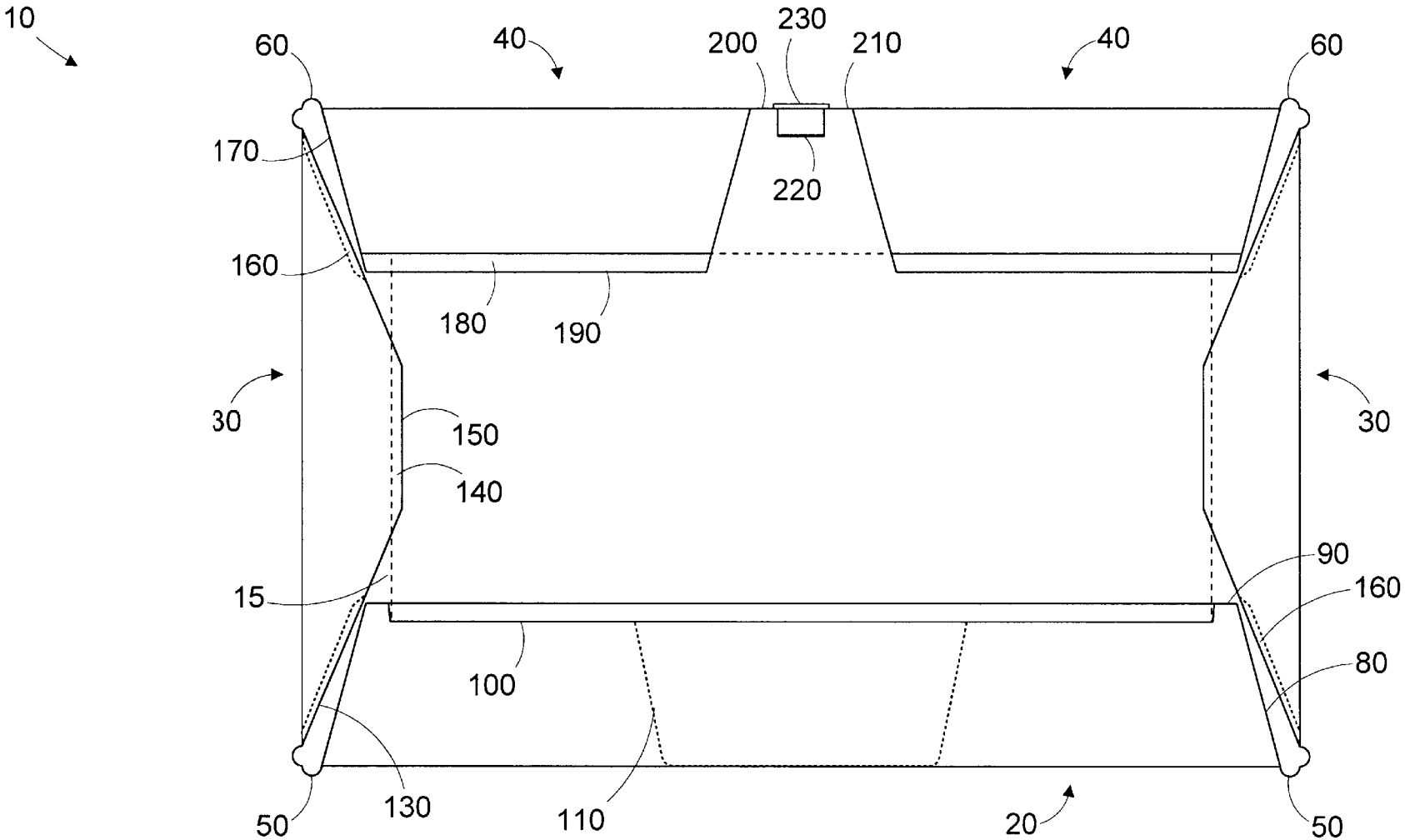
FIG. 3 is an end view of the packaging tray of FIG. 1 in an closed position.

The side members 30 include sloped sidewalls 130 and channels 140 defined in a top surface 150. The angles of the sidewalls 130 of the side members 30 and the sidewalls 80 of the base member 20 cooperate to position the channels 140 at an approximately 90° angle relative to the channels 100 when the packaging tray 10 is in a closed position (as shown in FIG. 3). Pockets 160 are defined in the sidewalls 80 for providing additional cushioning to the processor modules 15 from potential side impacts experienced during shipping.

The top members 40 include sloped sidewalls 170 and channels 180 defined in a top surface 190. The angles of the sidewalls 130 of the side members 30 and the sidewalls 170 of the top members 40 cooperate to form an approximately 90° angle between the channels 140, 180 when the packaging tray 10 is in a closed position. The top members 40 include overlapping flanges 200, 210 with cooperating fasteners 220, 230. In the illustrated embodiment, the fastener 220 is a square button extending from the flange 200, and the fastener 230 is a round button extending from the flange 210. The fasteners 220, 230 frictionally engage one another and hold the packaging tray 10 in the closed position. It is contemplated that other fastener types may be used, such as cooperating hook and loop fasteners, for example.

As seen in FIG. 3, with the packaging tray 10 in the closed position, the processor modules 15 are offset from the edges of the packaging tray 10. In such an arrangement, air spaces present around the processor modules 15 isolate them from impacts to the shipping box that holds the packaging tray 10.

Although the invention is illustrated as having symmetric side and top members, 30, 40, various alternative embodiments are possible. For example, only one top member 40, similar in size to the base member 20 may be used. One of the side members 30 may have a flange for interfacing with the top member 40. In another embodiment, the channels 140 on the side members 30 may be omitted. The channels 180 in the top members 40 may include end walls, similar to the end walls 120 in the channels 100 in the base member 20, for preventing lateral displacement of the processor modules.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A packaging tray, comprising:

a base member having a first plurality of channels defined therein;

first and second side members extending from the base and being rotatable with respect to the base; and first and second top members extending from the first and second side members, respectively, and being rotatable with respect to the first and second side members, the first top member including a second plurality of channels defined therein, the second top member including a third plurality of channels defined therein, and the first plurality of channels being aligned with the second and third pluralities of channels.

2. The packaging tray of claim 1, wherein the first and second side members include fourth and fifth respective pluralities of channels formed therein, the fourth and fifth pluralities of channels being aligned with the first, second, and third pluralities of channels.

3. The packaging tray of claim 1, wherein the base member includes:

a bottom edge;

sidewalls extending from the bottom edge; and a top surface defined between the sidewalls, the first plurality of channels being defined in the top surface.

4. The packaging tray of claim 3, further comprising at least one support foot defined in the top surface, the support foot extending downwardly from the top surface and being in substantially the same plane as the bottom edge.

5. The packaging tray of claim 1, wherein each of the first plurality of channels includes end walls.

6. The packaging tray of claim 2, wherein the first and second side members each include:

a bottom edge;

sidewalls extending from the bottom edge; and a top surface defined between the sidewalls, the fourth and fifth pluralities of channels being defined in the top surfaces of the first and second side members.

7. The packaging tray of claim 1, wherein the first and second top members each include:

a bottom edge;

sidewalls extending from the bottom edge; and a top surface defined between the sidewalls, the second and third pluralities of channels being defined in the top surfaces of the first and second top members.

8. The packaging tray of claim 1, further comprising first and second hinges defined between the base member and the first and second side members.

9. The packaging tray of claim 8, wherein the first and second hinges comprises bends having a w-shaped cross section.

10. The packaging tray of claim 1, further comprising a first hinge defined between the first top member and the first side member and a second hinge defined between the second top member and the second side member.

11. The packaging tray of claim 10, wherein the first and second hinges comprise bends having a w-shaped cross section.

12. The packaging tray of claim 1, wherein the first top member includes a first flange and the second top member includes a second flange, the first and second flanges cooperating to secure the first top member to the second top member.

13. The packaging tray of claim 12 wherein the first flange includes a first fastener and the second flange includes a second fastener adapted to engage the first fastener.

14. The packaging tray of claim 13 wherein the first fastener comprises a round button and the second fastener comprises a square button.

* * * * *